US007828911B2

(12) United States Patent
Gentschev et al.

(10) Patent No.: US 7,828,911 B2
(45) Date of Patent: Nov. 9, 2010

(54) COLORED CONVERSION LAYERS DEVOID OF CHROME FORMED ON METAL SURFACES

(75) Inventors: Pavel Gentschev, Duesseldorf (DE); Matthias Schweinsberg, Langenfeld (DE); Marco Bastian, Duesseldorf (DE); Ulrich Jueptner, Hilden (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 240 days.

(21) Appl. No.: 11/418,420

(22) Filed: May 4, 2006

(65) Prior Publication Data

US 2006/0272748 A1 Dec. 7, 2006

Related U.S. Application Data

(63) Continuation of application No. PCT/EP2004/011315, filed on Oct. 9, 2004.

(30) Foreign Application Priority Data

Nov. 7, 2003 (DE) ..... 103 52 076

(51) Int. Cl.
*C23C 22/66* (2006.01)
*C23C 22/60* (2006.01)
*C23C 22/05* (2006.01)

(52) U.S. Cl. ..... 148/270; 148/243; 148/275; 148/276; 148/277; 148/284; 148/285; 106/14.05; 106/14.11; 106/14.21

(58) Field of Classification Search ..... 148/243, 148/270, 275, 276, 277, 284, 285; 106/14.05, 106/14.11, 14.21
See application file for complete search history.

(56) References Cited

U.S. PATENT DOCUMENTS

| | | | | |
|---|---|---|---|---|
| 4,381,203 | A | 4/1983 | Reinhold | |
| 4,509,992 | A | 4/1985 | Higgins | |
| 5,584,946 | A | 12/1996 | Karmaschek et al. | |
| 6,022,425 | A * | 2/2000 | Nelson et al. | 148/272 |
| 6,752,878 | B2 * | 6/2004 | Montano et al. | 148/243 |
| 7,186,305 | B2 * | 3/2007 | Ferrier | 148/248 |
| 2004/0177898 | A1 * | 9/2004 | Magnusson | 148/255 |

FOREIGN PATENT DOCUMENTS

| | | | |
|---|---|---|---|
| EP | 0 346 827 | A1 | 12/1989 |
| WO | WO 94/25640 | A1 | 11/1994 |
| WO | WO 94/28193 | A1 | 12/1994 |
| WO | WO 95/14117 | A1 | 5/1995 |
| WO | WO 00/26437 | A1 | 5/2000 |

OTHER PUBLICATIONS

Salt spray testing (DIN 50 021) Beuth Verlag GmbH, Berlin, pp. 1-6 (1988).

* cited by examiner

*Primary Examiner*—Roy King
*Assistant Examiner*—Lois Zheng
(74) *Attorney, Agent, or Firm*—Mary Cameron

(57) ABSTRACT

A method for producing coloured layers on zinc, aluminium, magnesium or alloy surfaces. The surfaces are brought into contact with an aqueous treatment solution which is devoid of chrome, said solution containing, in total, 3-35 g/l persulfate ions and/or peroxodisulfate ions and not more than 10 g/l ammonia or ammonium ions, it has a pH value in the region of between 10-12 and a temperature in the range of between 30-80° C. The surfaces are brought into contact with the treatment solution for a period in the region of 0.5-5 minutes and optionally, they are covered with a coating based on organic polymers. The invention further relates to metal parts treated according to said method.

11 Claims, No Drawings

COLORED CONVERSION LAYERS DEVOID OF CHROME FORMED ON METAL SURFACES

CROSS-REFERENCE TO RELATED APPLICATIONS

This application is a continuation of International Application Number PCT/EP2004/011315, published in a non-English language, having an international filing date of Oct. 9, 2004, and claims priority from DE 10352076.7 filing date Nov. 7, 2003.

FIELD OF THE INVENTION

This invention relates generally to the chemical surface treatment of zinc or galvanized steel, aluminium, magnesium or alloys thereof. More particularly, the invention relates to chromium-free conversion processes for such metal surfaces, i.e. to chemical treatment processes leading to the formation of a surface layer in which both cations of the treated metal surface and ions from the treatment solution are incorporated. The chromium-free coating is colored, so that it is possible to tell by simple visual monitoring whether a satisfactory conversion layer has been formed. The function of this conversion layer is to reduce the tendency of the metal surface towards corrosion and to establish firm adhesion between the metal surface and an organic coating applied to the conversion layer, for example in the form of a paint or an adhesive.

BACKGROUND OF THE INVENTION

The formation of chromium-free conversion layers on the metal surfaces mentioned is covered by extensive prior art literature as cited, for example, in WO 94/28193.

It is clear from many of the documents cited therein that the conversion layers formed are colorless and transparent, so that the treated metal surfaces are bright in appearance. However, from many years' experience in the chromating of metal surfaces, the expert in this field is accustomed to obtaining a colored layer as the outcome of the conversion treatment. He is then able to see immediately whether the treatment has been successful. However, in the production of colorless layers, more elaborate surface analysis is required for this purpose, for example determination of the Ti content of the surface by X-ray fluorescence measurement. Accordingly, there is a need in practice for surface treatment processes which not only match conventional chromating layers in regard to corrosion prevention and paint adhesion properties, but, like chromating layers, are also visible to the human eye.

Attempts to solve this problem can be found in the prior art. For example, WO 94/25640 describes a process for producing blue-colored conversion layers on zinc/aluminium alloys. In this process, the metal surfaces are contacted with a treatment solution which has a pH value of 3.5 to 6 and which contains 0.2 to 3.0% by weight molybdenum and 0.1 to 2.0% by weight fluoride. The molybdenum may be used as molybdate, as phosphomolybdic acid, as molybdenum chloride and the like. The fluoride may be used in the form of hydrofluoric acid, simple fluorides and also complex fluoro acids, such as fluorotitanic acid or fluorozirconic acid for example.

A similar treatment process is described in WO 95/14117 although the appearance of the conversion layers is not discussed in detail. According to this document, the treatment solution contains hetero-oxo anions of molybdenum, tungsten or vanadium with one of the heteroions phosphorus, aluminium, silicon, manganese, zirconium, titanium, tin, cerium or nickel. In addition, the treatment solution contains an organic film former which may be selected, for example, from acrylates. The hetero-oxo anions, such as anions of heteropolyacids for example, may be directly formed in the treatment solution by addition of the relevant starting materials, for example molybdate ions and phosphoric acid, to the treatment solution. In addition, the treatment solution is said preferably to contain an etching reagent for aluminium, for example fluoride, tetrafluoroborate or similarly acting etching reagents.

According to the teaching of WO 00/26437, the conversion layer is colored by an organic dye (alizarin dye). The conversion layer itself is formed with a treatment solution which contains complex fluorides, for example of titanium and zirconium, besides other inorganic oxides, hydroxides or carbonates or reaction products thereof with the fluoro acids. In addition, a poly-4-hydroxystyrene (polyvinyl phenol) substituted by amino groups may be present as an organic polymer.

According to FR-A-2 461 764, colored layers can be formed on aluminium by chemical oxidation with aromatic nitro compounds. For example, the various position isomers of nitrobenzoic acid may be used for this purpose. The chemical oxidation of aluminium surfaces with persulfate ions is described in DE-A-741 337. However, the goal there is to produce glass-clear and colorless layers on aluminium and its alloys. According to the document in question, such layers are produced by allowing ammonia in the form of a hot aqueous solution additionally containing added alkali metal persulfate (preferably 1%) to act on the carefully cleaned light metal. Cleaning can be carried out, for example, by immersion in concentrated nitric acid. The treatment with the ammoniacal persulfate solution is carried out at temperatures of at least 70° C. over a period of about 15 to 60 minutes. It is pointed out that protective layers are also obtained at temperatures below 70° C., but are less permeable to light and often tinged with yellow. In the context of the disclosure of the cited document, yellow-tinged layers such as these are clearly undesirable because the treated parts are not intended to be painted, but to retain their metallic appearance.

SUMMARY OF THE INVENTION

One object of the invention is to provide a process for producing colored layers on surfaces of zinc, aluminium, magnesium or alloys thereof comprising contacting the surfaces with a chromium-free aqueous treatment solution which comprises, preferably consists essentially of, most preferably consists of a total of 3 to 35 g/l persulfate ions and/or peroxodisulfate ions and no more than 10 g/l ammonia or ammonium ions and which has a pH of 10 to 12 and a temperature of 30 to 70° C., the surfaces being contacted with the treatment solution for 0.5 to 5 minutes. Preferably, the treatment solution contains 8 to 35 g/l persulfate ions.

Another object of the invention is to provide a process for treating surfaces of zinc, aluminium, magnesium or alloys thereof, comprising:

a) cleaning the surfaces with an alkaline cleaning solution,
b) descaling the surfaces with an acidic solution, and
c) contacting the surfaces for 0.5 to 5 minutes with a chromium-free aqueous treatment solution which comprises, preferably consists essentially of, most preferably consists of a total of 3 to 35 g/l persulfate ions and/or peroxodisulfate ions and which has a pH of 10 to 12 and a temperature of 30 to 70° C.

It is a further object of the invention to provide a process as above-described, characterized in that the persulfate and/or peroxodisulfate ions are introduced as alkali metal salts and the pH of the aqueous treatment solution is adjusted with soda and/or potash lye.

It is a yet further object of the invention to provide a process as above-described, characterized in that the aqueous treatment solution contains no more than 1 g/l ammonia or ammonium ions.

It is another object of the invention to provide a process as above-described, characterized in that the aqueous treatment solution contains no other metal ions than alkali metal and/or alkaline earth metal ions.

It is a further object of the invention to provide a process as above-described, characterized in that the aqueous treatment solution additionally contains 1 to 50 g/l sulfate ions.

It is also an object of the invention to provide a process as above-described, wherein after contacting with the aqueous treatment solution, the metal surfaces are rinsed and provided with a coating based on organic polymers.

Another object of the invention is to provide metal strips, metal plates or metal parts which have surfaces of zinc, aluminium, magnesium or alloys thereof and which, on those surfaces, carry layers produced by the above-described processes.

DETAILED DESCRIPTION OF THE INVENTION

The authors of the present invention have found that, by lowering the temperature and shortening the treatment time, as compared to the teaching of DE-A-741 337, it is possible to obtain colored (light gold to gold-colored) layers on surfaces of suitable metals which, on the one hand, are chromium-free and, on the other hand, show excellent adhesion to a subsequently applied coating based on organic polymers, for example in the form of a paint or an adhesive.

In a first embodiment, the present invention relates to a process for producing colored layers on surfaces of zinc, aluminium, magnesium or alloys thereof in which the surfaces are contacted with a chromium-free aqueous treatment solution which contains a total of 3 to 35 g/l persulfate ions and/or peroxodisulfate ions and no more than 10 g/l ammonia or ammonium ions and which has a pH of 10 to 12 and a temperature of 30 to 70° C., the surfaces being contacted with the treatment solution for 0.5 to 5 minutes. For example, the treatment solution may contain 8 to 35 g/l persulfate ions.

The persulfate and/or peroxodisulfate ions are preferably introduced into the treatment solution as alkali metal salts, more particularly as the sodium or potassium salt. The alkaline pH required is preferably adjusted with a lye, more particularly with soda lye and/or potash lye. This eliminates the odor problems that would otherwise occur with hot alkaline ammonia solutions, as must clearly be the case with the process according to DE-A-741 337. The aqueous treatment solution preferably contains no more than 1 g/l ammonia or ammonium ions.

According to DE-A-741 337, temperatures of at least 70° C. and treatment times of about 15 to about 60 minutes are required for the described ammoniacal solutions. By contrast, the treatment solution used in the process according to the invention has a temperature of 30 to 70° C. Although strongly colored layers are also obtained at temperatures above 70° C., these layers do show reduced paint adhesion. The treatment time is 0.5 to 5 minutes. If the treatment time is shorter, the layers formed are unsatisfactory. Although treatment times of longer than 5 minutes lead to strongly colored layers, paint adhesion to those layers deteriorates.

According to DE-A-741 337, the surfaces are cleaned before the chemical oxidation step. This can be done, for example, by brief pickling in cold concentrated nitric acid. Alternatively, the surfaces may be rubbed down with a chamois. By contrast, it has proved to be favorable in the process according to the invention first to clean the metal surfaces with an alkaline cleaning solution, optionally to rinse them with water, preferably with deionized water, and then to descale them in an acidic solution, for example in nitric acid. In this way, the metal surfaces are prepared so that, on the one hand, they take on a uniform light gold to golden color in the chemical oxidation process step and, on the other hand, show good adhesion to a subsequent coating based on organic polymers.

Accordingly, in a second embodiment, the present invention relates to a process for treating surfaces of zinc, aluminium, magnesium or alloys thereof, in which the surfaces are a) cleaned with an alkaline cleaning solution, b) descaled with an acidic solution, and c) then contacted for 0.5 to 5 minutes with a chromium-free aqueous treatment solution which contains a total of 3 to 35 g/l persulfate ions and/or peroxodisulfate ions and which has a pH of 10 to 12 and a temperature of 30 to 70° C.

After contacting with the persulfate- or peroxodisulfate-containing treatment solution, the metal surfaces are rinsed with water, preferably with deionized water. Depending on the nature of the subsequent coating with organic polymers, the metal surfaces are optionally dried after rinsing with water. If the coating with organic polymers is carried out, for example, by immersing the metal surfaces in a water-based paint dispersion, there is no need for drying after rinsing. However, if the coating based on organic polymers is an adhesive or powder coating, for example, the metal surfaces are preferably dried before this step.

For economic and ecological reasons, the treatment solution preferably contains no metal ions other than alkali metal and optionally alkaline earth metal ions, for example no zinc ions and, above all, no heavy metal ions.

The aqueous treatment solution may additionally contain about 1 to about 50 g/l sulfate ions, for example in the form of sodium or potassium salts. An excess of sulfate ions suppresses hydrolysis of the persulfate and/or peroxodisulfate ions without impairing their effectiveness in producing a colored layer. Accordingly, the content of persulfate and/or peroxodisulfate ions in the aqueous treatment solution has to be replenished less often or to a lesser extent which saves expense on chemicals.

Finally, in a third embodiment, the present invention relates to a process, as herein described, wherein after contacting with the aqueous treatment solution, the metal surfaces are rinsed and provided with a coating based on organic polymers. The metal strips, metal plates or metal parts may carry a coating based on organic polymers, for example one or more paint layers or an adhesive layer, on the colored conversion layer formed by the treatment with the persulfate- and/or peroxodisulfate-containing solution. The metal parts produced in accordance with the invention may be joined to other metal parts through this adhesive layer. The present invention also encompasses corresponding metal strips, metal plates or metal parts.

EXAMPLES

Test plates of aluminium Al 99.5 (the alloys $AlMgSi_1$, AlMgSiMn and $AlMgSi_{0.5}$ lead to similar results) were subjected to the following treatment steps:

1. Cleaning with a commercial alkaline cleaner: Ridoline® C72 (Henkel), 2%, 65° C., 1 minute
2. Rinsing with deionized water
3. Deoxidizing with a commercial deoxidizing solution: Deoxidizer® 4902 (Henkel), 10 g/l, 25° C., 1.5 minutes
4. Rinsing with deionized water
5. Chemical oxidation with treatment solutions according to Table 1
6. Rinsing with deionized water
7. Drying
8. Painting with a powder coating (AL 93-7005, gray, Herberts)

To test paint adhesion, the painted test plates were subjected to a boiling test with cross-hatching. To this end, the painted test plates were boiled for 2 hours in deionized water and then stored for 1 hour at room temperature. The cross-hatch test was then carried out. A score of GT=0 represents a pass while scores of GT>0 represent failure. The test plates were also corrosion-tested (salt spray test to DIN 50021 SS) and paint creepage under a scratch was measured to DIN 53167. The results are set out in Table 1.

TABLE 1

Treatment parameters and treatment results

| Test No. | Treatment solution | pH value | Temp. (° C.) | Time (mins.) | Cross hatch salt spray test |
|---|---|---|---|---|---|
| 1 | 20 g/l $Na_2S_2O_8$ in water | 10.2 (NaOH) | 55 | 3 | GT = 0, O.K.<br>21 days: 0.7–1.1 mm<br>42 days: 0.9–1.5 mm |
| 2 | 12.7 g/l $Na_2S_2O_8$ in water | 10.2 (NaOH) | 55 | 3 | |
| 3 | 10 g/l $Na_2S_2O_8$ in water | 10.2 (NaOH) | 55 | 3 | |
| 4 | 5 g/l $Na_2S_2O_8$ in water | 10.2 (NaOH) | 55 | 3 | |
| 5 | 21 g/l $Na_2S_2O_8$ and 10 g/l $Na_2SO_4$ in water | 10.5 (NaOH) | 30 | 3 | |

Light gold- to gold-colored layers were obtained under all conditions.

What is claimed is:

1. A process for producing colored layers on surfaces of aluminum, magnesium or alloys thereof, comprising contacting a metal surface of aluminum, magnesium or an alloy thereof with a chromium-free aqueous treatment solution consisting of:

water;

a total of 3 to 35 g/l persulfate ions and/or peroxodisulfate ions;

no more than 1 g/l ammonia or ammonium ions;

alkali metal ions;

optionally a lye; and optionally contains 1 to 50 g/l sulfate ions;

wherein the aqueous treatment solution has a pH of 10 to 12, thereby producing a colored layer on said metal surface.

2. The process as claimed in claim 1, wherein the treatment solution contains 4 to 17 g/l persulfate ions.

3. The process as claimed in claim 1, wherein the treatment solution contains 8 to 35 g/l persulfate ions.

4. The process as claimed in claim 1, wherein the treatment solution has a temperature of 30 to 55° C.

5. The process as claimed in claim 1, wherein the persulfate and/or peroxodisulfate ions are introduced as alkali metal salts and the pH of the aqueous treatment solution is adjusted with soda lye and/or potash lye.

6. A process for producing colored layers on surfaces of zinc, aluminum, magnesium or alloys thereof, comprising contacting a metal surface of zinc, aluminum, magnesium or an alloy thereof with a chromium-free aqueous treatment solution consisting of: water, a total of 3 to 35 g/l persulfate ions and/or peroxodisulfate ion; alkali metal and/or alkaline earth metal ions; for 0.5 to 5 minutes, wherein the aqueous treatment solution is adjusted to a pH of 10 to 12 by addition of a pH adjuster, a temperature of 30 to 70° C., and optionally contains 1 to 50 g/l sulfate ions, thereby producing a colored layer on said metal surface.

7. The process as claimed in claim 6, wherein the treatment solution contains 8 to 35 g/l persulfate ions.

8. The process as claimed in claim 6, wherein the treatment solution additionally contains 1 to 50 g/l sulfate ions.

9. The process as claimed in claim 6, wherein the persulfate and/or peroxodisulfate ions are introduced as alkali metal salts and the pH of the aqueous treatment solution is adjusted with soda lye and/or potash lye.

10. The process as claimed in claim 9, wherein the aqueous treatment solution results from addition of 5 to 21 g/l alkali metal peroxodisulfate to the water.

11. The process as claimed in claim 6, wherein, after contacting with the aqueous treatment solution, the metal surfaces are rinsed and provided with a coating based on organic polymers.

* * * * *